United States Patent [19]

Fountoulakis

[11] Patent Number: 4,501,050

[45] Date of Patent: Feb. 26, 1985

[54] CLUTCH FOR POST EARRINGS

[76] Inventor: Marcos Fountoulakis, 24 Freemont St., Providence, R.I. 02906

[21] Appl. No.: 543,625

[22] Filed: Oct. 20, 1983

[51] Int. Cl.[3] ..... A44B 9/00

[52] U.S. Cl. ..... 24/155 R; 63/12

[58] Field of Search ..... 63/12, 13; 24/106, 108, 24/462, 155 R, 155 RB, 155 BB

[56] References Cited

U.S. PATENT DOCUMENTS

| | | | |
|---|---|---|---|
| 1,023,663 | 4/1912 | Kubicek | 24/155 RB |
| 1,024,762 | 4/1912 | Anderson | 24/155 R |
| 1,035,694 | 8/1912 | Dieffenbacher | 24/155 RB |
| 1,281,844 | 10/1918 | Roy | 24/155 RB |
| 3,187,751 | 8/1961 | Coren et al. | 63/12 X |

FOREIGN PATENT DOCUMENTS

| | | | |
|---|---|---|---|
| 22705 | of 1908 | United Kingdom | 24/155 RB |

*Primary Examiner*—F. Barry Shay

*Attorney, Agent, or Firm*—Salter & Michaelson

[57] ABSTRACT

A clutch for post earrings is disclosed. The clutch comprises a housing which is open at one end thereof and has an aperture therethrough in the opposite end thereof, a cap member which is received on the open end of the housing and also has an aperture therethrough, and a pair of resilient leaves which extend inwardly in the housing from the cap member in integral relation therewith and in converging relation with respect to each other, the leaves preferably meeting in substantially face-to-face relation at a point spaced from the cap member. The clutch is receivable on a post earring so that the post of the earring extends through the aperture in the cap member, between the face-to-face portions of the leaves and through the aperture in the housing. The leaves of the clutch are operative to resiliently embrace the post to retain it in the clutch for releasably securing the clutch on the earring.

4 Claims, 4 Drawing Figures

CLUTCH FOR POST EARRINGS

BACKGROUND AND SUMMARY OF THE INVENTION

The instant invention relates to earrings and more particularly to a clutch for post earrings of the type worn on pierced ears.

Post earrings have become extremely popular in recent years and are currently available in a wide range of styles. Most of the conventional post earrings currently available comprise a decorative ornament which is adapted to be worn on the front side of a pierced ear lobe, an elongated post which extends rearwardly from the ornament and is positionable so that it extends through the aperture or hole in the ear lobe, and an earring clutch which is detachably receivable on the post on the rear side of the ear lobe to prevent the post from being accidentally withdrawn from the aperture in the ear lobe. While a variety of types of clutches have heretofore been available for use in combination with post earrings, one particular type of clutch commonly known as a "bullet" clutch has proven to be popular with the more expensive post earrings. A conventional bullet clutch comprises a generally cylindrical housing which is open at one end thereof and has an aperture therethrough in the opposite end thereof, a rubber or silicone plug or insert having an aperture therethrough which is received in the housing, and a metal cap which is received on the open end of the housing, the cap having an aperture therethrough which is aligned with the aperture in the insert and in the housing. A conventional "bullet" clutch is receivable on the post of an earring so that the post extends through the apertures in the cap, the insert and the housing so that the silicone or rubber insert in the housing frictionally engages the post to releasably retain the clutch on the earring. While "bullet" clutches of this type have proven to be highly popular and relatively easy to use, they have also had disadvantages. Specifically, it has been found that conventional "bullet" clutches frequently become ineffective after several months because the silicone or rubber inserts used in clutches of this type tend to become hard and brittle, and therefore they become ineffective for frictionally grasping earring posts.

The instant invention provides a novel clutch for post earrings which is generally similar in appearance to the conventional "bullet" clutches heretofore available but which overcomes the disadvantages of the known "bullet" clutches. The clutch for post earrings of the instant invention comprises a housing which is open at one end thereof and preferably has an aperture therethrough in the opposite end thereof. A cap member is secured on the open end of the housing, the cap member having an aperture therethrough which is aligned with the aperture in the housing. A pair of resilient leaves extend inwardly in the housing from the cap member in integral relation therewith and in converging relation with respect to each other so that the leaves preferably meet in substantially face-to-face relation at a point which is spaced from the cap member. The clutch is receivable on the post of an earring so that the post extends through the aperture in the cap member, between the resilient leaves, and through the aperture in the housing. The leaves thus resiliently embrace the post to frictionally retain it in the clutch and thereby releasably secure the clutch on the earring. However, because the clutch includes the resilient leaves instead of a silicone or rubber insert, its effectiveness is not reduced after a period of use, and the clutch can be used indefinitely.

The closest prior art to the post-earring clutch of the instant invention of which the applicant is aware is disclosed in the U.S. patents to Carlyle No. 864,610; Kubicek No. 1,023,663; Dieffenbacher No. 1,035,694; Brine No. 1,069,845; Foster No. 1,208,939; and Lobar No. 1,338,783. These references disclose a variety of generally bullet-shaped clutches, many of which are intended for use as protectors for the ends of hat pins. None of the devices disclosed in the cited references, however, embody the novel and simple construction of the clutch of the instant invention; and hence the above references are only of general interest.

Accordingly, it is a primary object of the instant invention to provide a clutch for post earrings which is still effective in operation even after long periods of use.

Another object of the instant invention is to provide an effective bullet-type clutch for post earrings which does not require a rubber or silicone insert for securing the clutch on an earring post.

A still further object of the instant invention is to provide a bullet-type clutch for post earrings having a pair of inwardly extending converging leaves which are operative for detachably securing an earring post in place on the ear of a user.

Other objects, features and advantages of the invention shall become apparent as the description thereof proceeds when considered in connection with the accompanying illustrative drawings.

IN THE DRAWINGS:

In the drawings which illustrate the best mode presently contemplated for carrying out the present invention;

DESCRIPTION OF THE INVENTION

Figure 1:
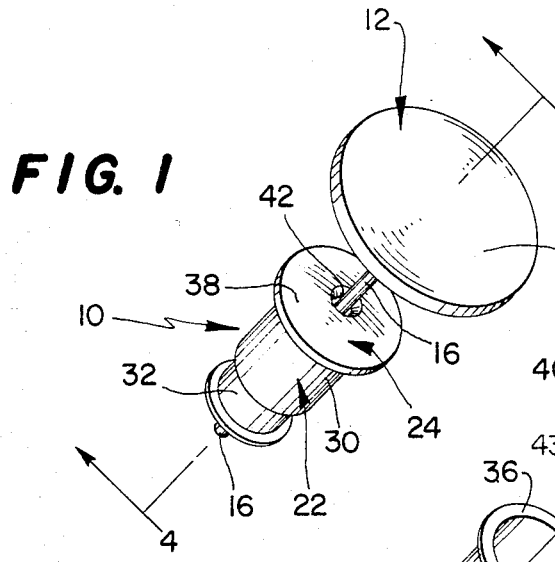
FIG. 1 is an enlarged perspective view of a clutch of the instant invention will a post earring received therein.
Figure 2:
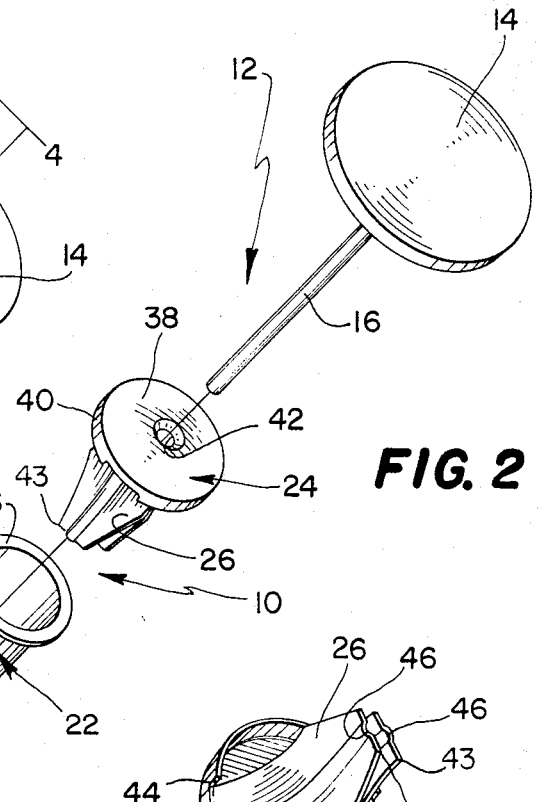
FIG. 2 is an enlarged exploded perspective view of the clutch and post earring.
Figure 4:
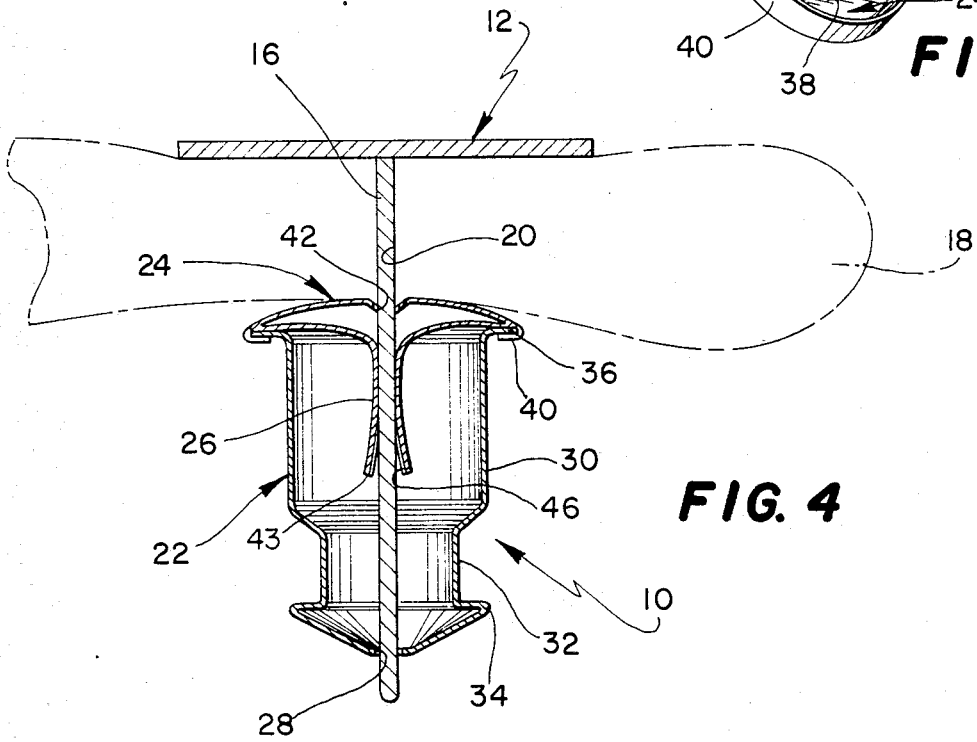
FIG. 4 is a greatly enlarged sectional view taken along line 4—4 in FIG. 1.

Referring now to the drawing, the post-earring clutch of the instant invention is illustrated and is generally indicated at 10 in FIGS. 1, 2, and 4. The clutch 10 is usable in combination with a post earring generally indicated at 12, of the type comprising a decorative ornament 14 and a post 16, and is operative for detachably retaining the earring 12 on a pierced ear of a wearer. Specifically, as illustrated in FIG. 4, when the earring 14 is received on a pierced ear lobe 18 of a wearer so that the ornament 14 is positioned on the front side of the ear lobe 18 and the post 16 extends through an aperture 20 in the ear lobe 18, the clutch 10 is located on the post 16 on the rear side of the ear lobe 18 for retaining the earring 12 on the ear lobe 18.

Referring now to FIGS. 2 and 4, the clutch 10 comprises a tubular shell or housing generally indicated at 22, a cap member generally indicated at 24 which is secured on the housing 22, and a pair of resilient leaves 26 which extend inwardly in converging relation into the housing 22 from the cap member 24 in integral relation with the cap member 24.

The housing 22 is preferably constructed of a suitable metal in a generally tubular cylindrical configuration which is open at one end thereof and has an aperture 28 that extends through the opposite end thereof. Preferably, the housing 22 is formed with a cylindrical main portion 30, a slightly reduced cylindrical intermediate portion 32 which extends from the main portion 30, and a terminal portion 34. The terminal portion 34 extends from the intermediate portion 32 and has a major diameter which is preferably approximately the same as that of the main portion 30, the terminal portion 34, however, tapering inwardly at the end thereof from its major diameter to the aperture 28 which extends substantially through the axis or center thereof. The construction of the housing 22 in this manner with portions of differing diameters facilitates the grasping thereof by a wearer, as is generally known in the art. Provided in the housing 22 at the opposite end thereof from the terminal portion 34 is a flange 36 which extends outwardly from the main portion 30 and circumferentially around the open end of the housing 22 for receiving the cap member 24, as will hereinafter be more fully set forth.

The cap member 24 and the leaves 26 are preferably integrally formed from a suitable piece of sheet metal in a metal stamping operation. The cap member 24 is also preferably formed with a substantially circular main portion 38 and a peripheral flange 40 which extends from the main portion 38, while the cap member 24 is dimensioned for being received on the housing 22 with the flange 36 of the housing 22 received within the flange 40. In the assembly of the cap member 24 to the housing 22 and as illustrated in FIG. 4, the flange 40 is preferably crimped into a substantially U-shaped configuration to capture the flange 36 of the housing 22 and thereby secure the cap member 24 thereto. The main portion 38 of the cap member 24 is preferably formed in a slightly outwardly rounded configuration, so that the end of the clutch thereby defined is slightly convex. Extending through the cap member 24 in substantially the central portion thereof is a recessed aperture 42 which, when the cap member 24 is assembled on the housing 22, is substantially in alignment with the aperture 28 so that the apertures 28 and 42 cooperate to substantially define the central axis of the clutch 10.

Figure 3:
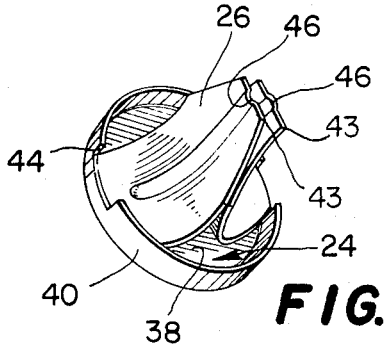
FIG. 3 is an even further enlarged perspective view of the cap member and leaves of the clutch of the instant invention.

The leaves 26 preferably integrally extend arcuately inwardly in converging relation from opposite peripheral side edges of the cap member 24, preferably meet in substantially face-to-face relation at a point which is spaced from the cap member 24, and terminate in substantially free ends 43, as illustrated most clearly in FIGS. 3 and 4. As will be seen from FIG. 3, notches 44 are formed in the flange 40 on opposite side edges of the cap member 24 where the leaves 26 extend integrally inwardly from the main portion 38. The leaves 26 are preferably of substantially arcuate configuration and have elongated facing grooves 46 therein which define a trackway between the leaves 26, the trackway being substantially in alignment with the apertures 42 and 28. In this connection, it should be pointed out that it is important that the trackway defined by the grooves 46 is of smaller cross section than the post 16 so that when the post 16 is received therein the facing portions of the leaves 26 are resiliently urged into embracing engagement with the post 16 to secure it in the clutch 10.

In use and operation of the clutch 10, the post 16 of the earring 12 is inserted through the hold or aperture in a pierced ear so that the ornament 14 is positioned against the front side of the ear lobe. The clutch 10 is then positioned on the post 16 by inserting the terminal end of the post 16 in the aperture 42. As the post 16 is further advanced into the clutch 10, it passes between the leaves 26 causing them to be resiliently separated slightly, and the post 16 is guided through the clutch 10 by the grooves 46 until the terminal end of the post 16 passes through the aperture 28. Normally, the clutch 10 is then further advanced on the post 16 until the main portion 38 of the cap member 24 is adjacent the rear side of the ear lobe. When the clutch 10 is positioned on an ear lobe in this manner, the leaves 26 embrace the post 16 to maintain it in the clutch 10, whereby the earring 12 is maintained on the ear of the wearer.

It is seen, therefore, that the instant invention provides an effective clutch for post earrings which has specific advantages over the heretofore available clutches. The resilient leaves 26 resiliently embrace the post 16 so that the clutch 10 firmly and positively maintains the earring 12 on an ear of a wearer; and since the clutch 10 does not include a silicone or rubber insert for retaining the post 16, it can be used indefinitely without losing its effectiveness. Accordingly, for these reasons, as well as the other reasons hereinabove set forth, it is seen that the clutch 10 represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A clutch for post earrings and the like comprising:

a. a housing which is open at one end thereof and has an aperture through the opposite end thereof, said housing having a generally outwardly extending peripheral flange at the open end thereof;

b. a cap member made of a sheet metal and received on the open end of said housing, said cap member comprising a substantially circular main portion having a substantially centrally disposed aperture therethrough and a generally inwardly extending peripheral flange having a pair of notches therein, said notches being disposed in substantially opposite portions of said cap member flange, said housing flange being captured betwen said cap member main portion and said cap member flange to secure said cap member to said housing; and c. a pair of resilient leaves made of said sheet metal which extend integrally inwardly from said cap member main portion at said notches, said leaves converging with respect to each other and substantially meeting in face-to-face relation for receiving a post therebetween, said post being receivable in said clutch so that it extends through said cap member and housing apertures and is received in frictional engagement between said leaves.

2. In the clutch of claim 1, said leaves further characterized as having substantially free terminal ends.

3. In the clutch of claim 1, said leaves being further characterized as extending arcuately inwardly and having substantially free terminal ends.

4. In the clutch of claim 1, said leaves being further characterized as having elongated facing grooves which cooperate to define a trackway in said clutch which is substantially in alignment with said apertures for receiving and aligning an earring post between said leaves.

* * * * *